US006543061B1

(12) United States Patent
Morgan

(10) Patent No.: US 6,543,061 B1
(45) Date of Patent: Apr. 8, 2003

(54) HEAD COVER ASSEMBLY

(76) Inventor: Sabrina Morgan, 916 Park Dr., Flossmoor, IL (US) 60422

( * ) Notice: Subject to any disclaimer, the term of this patent is extended or adjusted under 35 U.S.C. 154(b) by 0 days.

(21) Appl. No.: 09/931,833

(22) Filed: Aug. 17, 2001

(51) Int. Cl.[7] ..... A42B 1/00
(52) U.S. Cl. ..... 2/183; 2/68
(58) Field of Search ..... 2/183, 171.2, 174, 2/202, 204, 68

(56) References Cited

U.S. PATENT DOCUMENTS 1,531,394 A * 3/1925 Hart ..... 2/183
2,556,576 A * 6/1951 De Carolis ..... 2/183
2,647,264 A * 8/1953 Hutton ..... 2/183
4,468,815 A * 9/1984 Pellegri ..... 2/68
5,603,121 A * 2/1997 Borkovic et al. ..... 2/195.2
5,950,234 A * 9/1999 Leong et al. ..... 2/7

* cited by examiner

*Primary Examiner*—John J. Calvert
*Assistant Examiner*—Katherine Moran

(57) ABSTRACT

A head cover assembly for providing a user with a head covering that acts as a fashionable accessory that may offer enhanced comfort for users. The head cover assembly includes a skull member that has a perimeter wall defining a cavity. The cavity is adapted for receiving an upper portion of the head of the user. A fastening assembly is coupled to the skull member. The fastening assembly is adapted for securing the skull member tightly around the upper portion of the head of the user.

6 Claims, 2 Drawing Sheets

HEAD COVER ASSEMBLY

BACKGROUND OF THE INVENTION

1. Field of the Invention

The present invention relates to head covers and more particularly pertains to a new head cover assembly for providing a user with a head covering that acts as a fashionable accessory that may offer enhanced comfort for users.

2. Description of the Prior Art

The use of head covers is known in the prior art. More specifically, head covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,902,692; 2,624,052; 2,411,994; 2,398,246; 2,104,997; and U.S. Pat. No. Des. 110,941.

While these devices fulfill their respective, particular objectives and requirements, the aforementioned patents do not disclose a new head cover assembly. The inventive device includes a skull member that has a perimeter wall defining a cavity. The cavity is adapted for receiving an upper portion of the head of the user. A fastening assembly is coupled to the skull member. The fastening assembly is adapted for securing the skull member tightly around the upper portion of the head of the user.

In these respects, the head cover assembly according to the present invention substantially departs from the conventional concepts and designs of the prior art, and in so doing provides an apparatus primarily developed for the purpose of providing a user with a head covering that acts as a fashionable accessory that may offer enhanced comfort for users.

SUMMARY OF THE INVENTION

In view of the foregoing disadvantages inherent in the known types of head covers now present in the prior art, the present invention provides a new head cover assembly construction wherein the same can be utilized for providing a user with a head covering that acts as a fashionable accessory that may offer enhanced comfort for users.

The general purpose of the present invention, which will be described subsequently in greater detail, is to provide a new head cover assembly apparatus and method which has many of the advantages of the head covers mentioned heretofore and many novel features that result in a new head cover assembly which is not anticipated, rendered obvious, suggested, or even implied by any of the prior art head covers, either alone or in any combination thereof.

To attain this, the present invention generally comprises a skull member that has a perimeter wall defining a cavity. The cavity is adapted for receiving an upper portion of the head of the user. A fastening assembly is coupled to the skull member. The fastening assembly is adapted for securing the skull member tightly around the upper portion of the head of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new head cover assembly apparatus and method which has many of the advantages of the head covers mentioned heretofore and many novel features that result in a new head cover assembly which is not anticipated, rendered obvious, suggested, or even implied by any of the prior art head covers, either alone or in any combination thereof.

It is another object of the present invention to provide a new head cover assembly, which may be easily and efficiently manufactured and marketed.

It is a further object of the present invention to provide a new head cover assembly, which is of a durable and reliable construction.

An even further object of the present invention is to provide a new head cover assembly which is susceptible of a low cost of manufacture with regard to both materials and labor, and which accordingly is then susceptible of low prices of sale to the consuming public, thereby making such head cover assembly economically available to the buying public.

Still yet another object of the present invention is to provide a new head cover assembly, which provides in the apparatuses and methods of the prior art some of the advantages thereof, while simultaneously overcoming some of the disadvantages normally associated therewith.

Still another object of the present invention is to provide a new head cover assembly for providing a user with a head covering that acts as a fashionable accessory that may offer enhanced comfort for users.

Yet another object of the present invention is to provide a new head cover assembly, which includes a skull member that has a perimeter wall defining a cavity. The cavity is adapted for receiving an upper portion of the head of the user. A fastening assembly is coupled to the skull member. The fastening assembly is adapted for securing the skull member tightly around the upper portion of the head of the user.

Still yet another object of the present invention is to provide a new head cover assembly that would incorporate laces through which it could be secured to the wearer's head to prevent it from slipping, sagging or falling.

Even still another object of the present invention is to provide a new head cover assembly that would provide users with enhanced comfort as it would prevent their hair from falling forward into their faces and may absorb perspiration to prevent it from entering eyes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
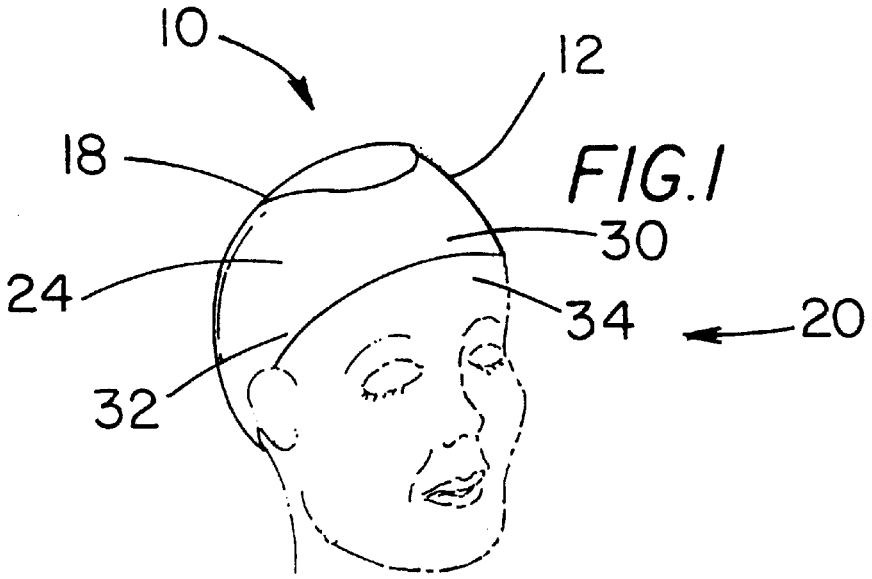
FIG. 1 is a perspective view of a new head cover assembly according to the present invention.
Figure 2:
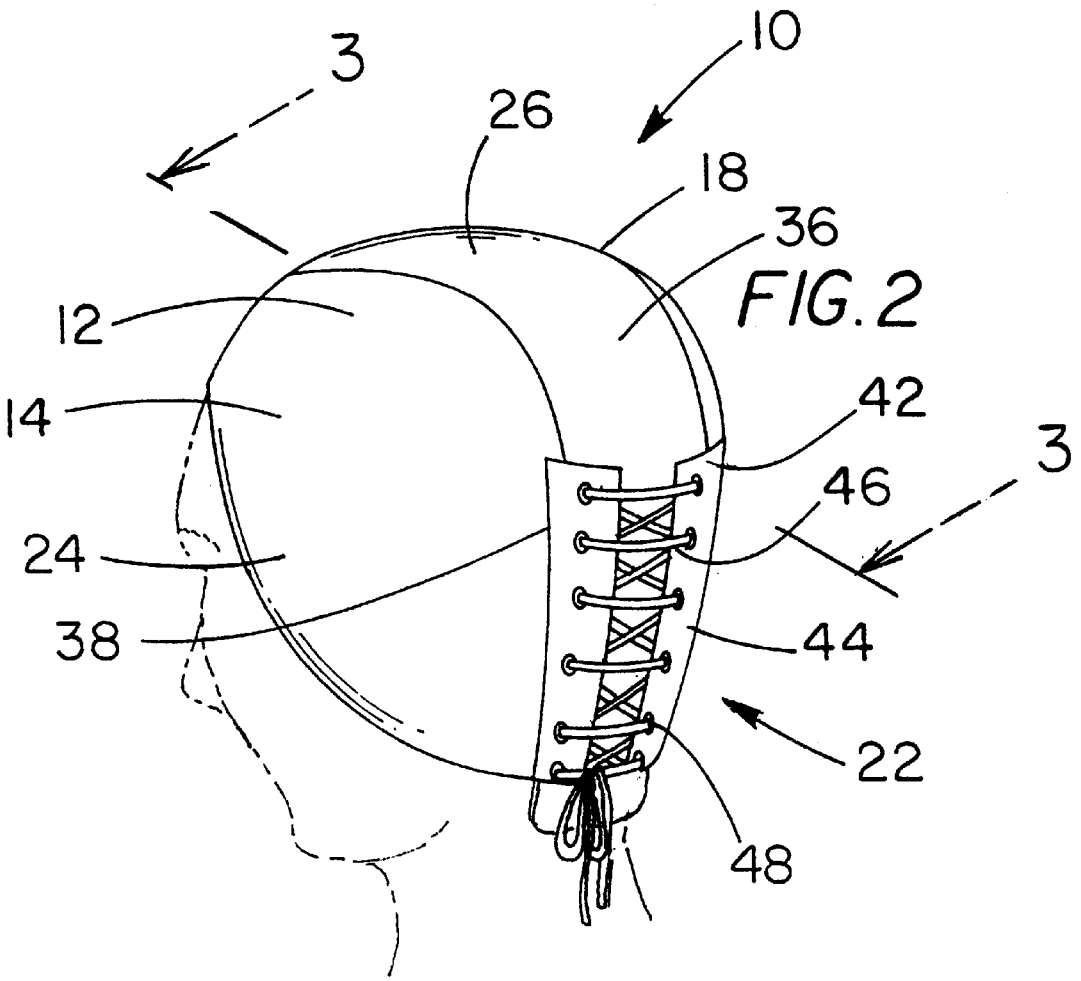
FIG. 2 is a perspective view of the present invention.
Figure 3:
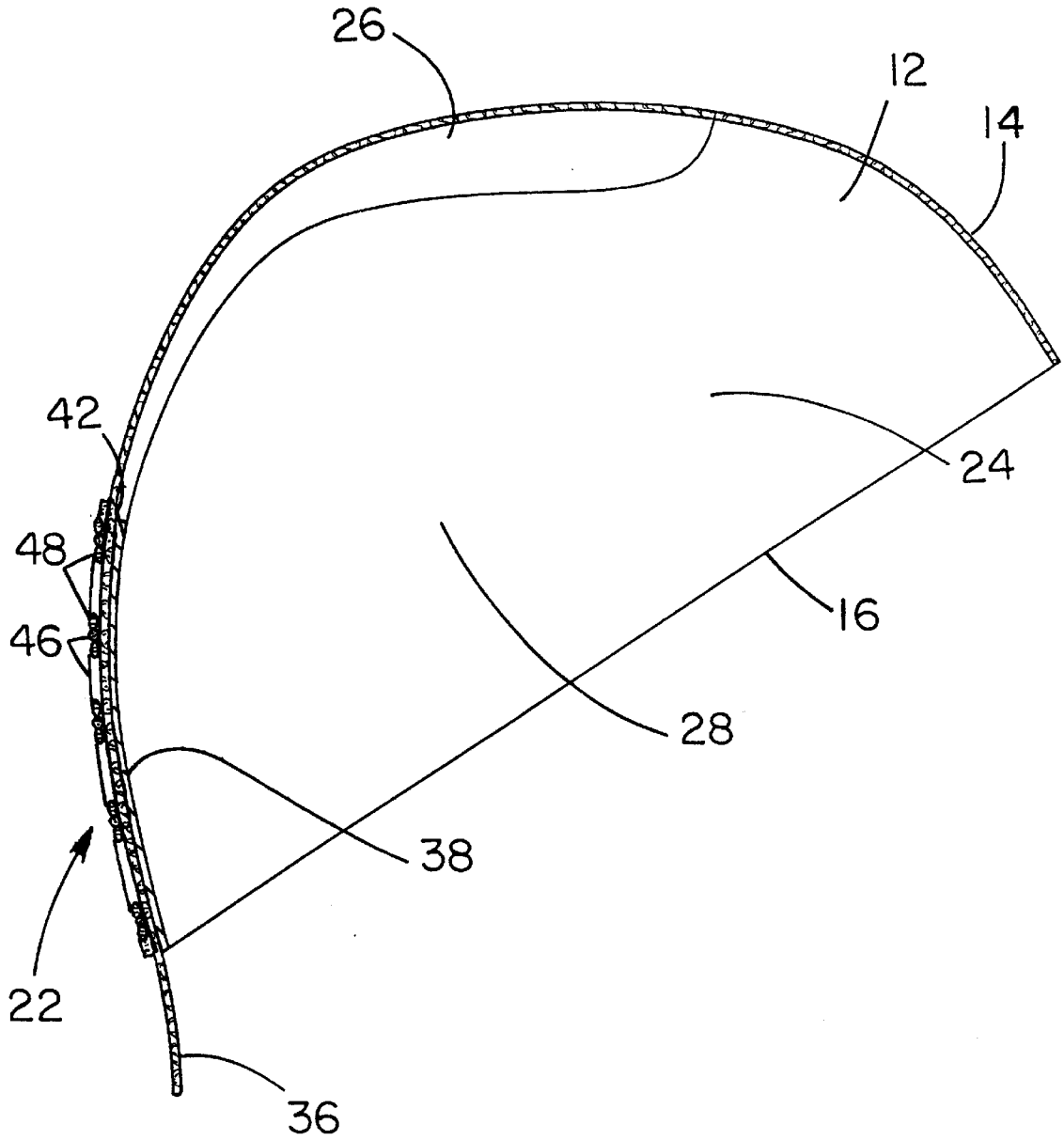
FIG. 3 is a side view of the present invention.

With reference now to the drawings, and in particular to FIGS. 1 through 3 thereof, a new head cover assembly embodying The principles and concepts of the present invention and generally Designated by the reference numeral 10 will be described.

As best illustrated in FIGS. 1 through 3, the head cover assembly 10 generally includes a skull member 12 that has a perimeter wall 14 defining a cavity 16. The cavity 16 is adapted for receiving an upper portion 18 of the head 20 of the user. A fastening assembly 22 is coupled to the skull member 12. The fastening assembly 22 is adapted for securing the skull member 12 tightly around the upper portion 18 of the head 20 of the user.

The perimeter wall 14 of the skull member 12 has a base portion 24 and a center portion 26. The base portion 24 has pair of side portions 28 and a frontal portion 30. The frontal portion 30 of the base portion 24 extends between the side portions 28. The center portion 26 is coupled to the base portion 24 such that each of the side portions 28 are positioned over a side 32 of the head 20 of the user and the frontal portion 30 is positioned over a forehead 34 of the head 20 of the user when the skull member 12 is worn on the head 20 of the user.

A tongue 36 is coupled to the center portion 26. The tongue 36 is positionable over a rear end 38 of each of the side portions 28 of the base portion 24 when the skull member 12 is positioned on the head 20 of the user. The tongue 36 is positioned between the skull member 12 and the fastening assembly 22 such that the tongue 36 is adapted for preventing hair of the user from becoming entangled in the fastening assembly 22 when the fastening assembly 22 is tightened.

An expansion portion 42 is coupled between the rear end 38 of each of the side portions 28 of the base portion 24. The Expansion portion 42 is adapted for permitting the skull member 12 to adjustably fit various sizes of heads 20 of various users. The expansion portion 42 includes an elastic material. The elastic material is for biasing the real end 38 of one of the side portions 28 of the base portion 24 towards the other of the side portions 28 of the base portion 24 such that the expansion portion 42 is adapted for snuggly fitting the skull member 12 around the head 20 of the user.

The fastening assembly 22 has a plurality of flap portions 44 and a lace 46. Each of the flap portions 44 is coupled to one of the side portions 28 of the base portion 24 of the skull member 12. Each of the flap portions 44 has a plurality of eyelets 48. The lace 46 is for alternatingly lacing between the eyelets 48 of the flap portions 44 such that pulling on ends of the lace 46 shortens a distance between the flap portions 44 thereby tightening the skull member 12 to the head 20 Of the user.

The eyelets 48 of each of the flaps are aligned along a length of an associated one of the flaps. The eyelets 48 are for distributing the force from the cinched lace 46 along the length of the flap portions 44 such that the eyelets 48 are adapted for evenly tightening the skull member 12 around the head 20 of the user.

In use, a user would place the present invention atop their head. Once in place, the laces could be pulled up and the ends would be tied into a knot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A head cover for wearing on a head of a user, the head cover comprising:

a skull member having an perimeter wall defining a cavity, said cavity being adapted for receiving an upper portion of the head of the user;

a fastening assembly being coupled to said skull member, said fastening assembly being adapted for securing said skull member tightly around the upper portion of the head of the user;

said perimeter wall of said skull member having a base portion and a center portion, said base portion having pair of side portions and a frontal portion, said frontal portion of said base portion extending between said side portions, said center portion being coupled to said base portion such that each of said side portions are positioned over a side of the head of the user and said front portion is positioned over a forehead of the head of the user when said skull member is worn on the head of the user; and a tongue being coupled to said center portion, said tongue positionable over a rear end of each of said side portions of said base portion when said skull member is positioned on the head of the user such that said tongue inhibits said rear end of each of said side portions from becoming entangled in said fastening assembly when said fastening assembly is tightened, said tongue being positioned between said skull member and said fastening assembly such that said tongue is adapted for preventing hair of the user from becoming entangled in said fastening assembly when said fastening assembly is tightened.

2. The head cover as set forth in claim 1, further comprising:

an expansion portion being coupled between a rear end of each of said side portions of said base portion, said expansion portion being adapted for permitting said skull member to adjustably fit various sizes of heads of various users.

3. The head cover as set forth in claim 2, further comprising:

said expansion portion comprising an elastic material, said elastic material biasing said rear end of one of said side portions of said base portion towards the other of said side portions of said base portion such that said expansion portion is adapted for snuggly fitting said skull member around the head of the user.

4. The head cover as set forth in claim 2, further comprising:

said fastening assembly having a plurality of flap portions and a lace, each of said flap portions being coupled to one of said side portion of said base portion of said skull member, each of said flap portions having a plurality of eyelets, said lace being for alternatingly lacing between said eyelets of said flap portions such that pulling on ends of said lace shortens a distance between said flap portion thereby tightening said skull member to the head of the user.

5. The head cover as set forth in claim 4, further comprising:

said eyelets of each of said flaps being aligned along a length of an associated one of said flaps, said eyelets distributing the force from the cinched lace along said length of said flap portions such that said eyelets are adapted for evenly tightening said skull member around the head of the user.

6. A head cover for wearing on a head of a user, the head cover comprising:

a skull member having an perimeter wall defining a cavity, said cavity being adapted for receiving an upper portion of the head of the user;

a fastening assembly being coupled to said skull member, said fastening assembly being adapted for securing said skull member tightly around the upper portion of the head of the user;

wherein said perimeter wall of said skull member having a base portion and a center portion, said base portion having pair of side portions and a frontal portion, said frontal portion of said base portion extending between said side portions, said center portion being coupled to said base portion such that each of said side portions are positioned over a side of the head of the user and said front portion is positioned over a forehead of the head of the user when said skull member is worn on the head of the user;

wherein a tongue being coupled to said center portion, said tongue positionable over a rear end of each of said side portions of said base portion when said skull member is positioned on the head of the user such that said tongue inhibits said rear end of each of said side portions from becoming entangled in said fastening assembly when said fastening assembly is tightened, said tongue being positioned between said skull member and said fastening assembly such that said tongue is adapted for preventing hair of the user from becoming entangled in said fastening assembly when said fastening assembly is tightened;

wherein an expansion portion being coupled between said rear end of each of said side portions of said base portion, said expansion portion being adapted for permitting said skull member to adjustably fit various sizes of heads of various users;

wherein said expansion portion comprising an elastic material, said elastic material biasing said rear end of one of said side portions of said base portion towards the other of said side portions of said base portion such that said expansion portion is adapted for snuggly fitting said skull member around the head of the user;

wherein said fastening assembly having a plurality of flap portions and a lace, each of said flap portions being coupled to one of said side portion of said base portion of said skull member, each of said flap portions having a plurality of eyelets, said lace being for alternatingly lacing between said eyelets of said flap portions such that pulling on ends of said lace shortens a distance between said flap portion thereby tightening said skull member to the head of the user; and wherein said eyelets of each of said flaps being aligned along a length of an associated one of said flaps, said eyelets distributing the force from the cinched lace along said length of said flap portions such that said eyelets are adapted for evenly tightening said skull member around the head of the user.

* * * * *